US006842951B1

(12) United States Patent
Barre et al.

(10) Patent No.: US 6,842,951 B1
(45) Date of Patent: Jan. 18, 2005

(54) CLOTHES PEG

(75) Inventors: Bertrand Barre, Limonest (FR); Francis LePage, Lyons (FR)

(73) Assignee: Genprod, Limonest (FR)

( * ) Notice: Subject to any disclaimer, the term of this patent is extended or adjusted under 35 U.S.C. 154(b) by 0 days.

(21) Appl. No.: 10/111,613

(22) PCT Filed: Oct. 26, 1999

(86) PCT No.: PCT/FR99/02607

§ 371 (c)(1),
(2), (4) Date: Jul. 8, 2002

(87) PCT Pub. No.: WO01/31108

PCT Pub. Date: May 3, 2001

(51) Int. Cl.[7] ..... A44B 21/00; B25B 5/00

(52) U.S. Cl. ..... 24/499; 501/510; 501/515; 501/530

(58) Field of Search ..... 24/499, 515, 517, 24/519, 520, 521, 522, 523, 530, 489, 500, 510, 516, 487, 318, 509, 332; 248/75

(56) References Cited

U.S. PATENT DOCUMENTS

| | | | | | |
|---|---|---|---|---|---|
| 10,163 | A | * | 10/1853 | Smith | 24/509 |
| 2,209,697 | A | | 7/1940 | Kislingbury et al. | |
| 2,537,703 | A | * | 1/1951 | Randa | 248/75 |
| 2,766,500 | A | * | 10/1956 | Chanko | 24/499 |
| 3,128,517 | A | * | 4/1964 | Alley | 24/499 |
| 3,135,034 | A | * | 6/1964 | Fauteux | 24/499 |
| 3,649,954 | A | * | 3/1972 | Kurtz | 339/95 R |
| 3,780,402 | A | | 12/1973 | Takabayashi | |
| 4,063,333 | A | * | 12/1977 | Schweitzer | 24/499 |
| 4,722,120 | A | | 2/1988 | Lu | |
| 5,075,935 | A | * | 12/1991 | Abdi | 24/511 |
| 5,226,892 | A | * | 7/1993 | Boswell | 24/543 |
| 5,325,570 | A | * | 7/1994 | Chin-Ho | 24/530 |
| 5,765,820 | A | * | 6/1998 | Marusiak | 24/501 |
| 5,855,046 | A | | 1/1999 | Dymott et al. | |
| 6,263,703 | B1 | * | 7/2001 | Kenney | 24/510 |

FOREIGN PATENT DOCUMENTS

| | | |
|---|---|---|
| DE | 528 259 C | 6/1931 |
| EP | 0 302 135 A1 | 2/1989 |
| EP | 0 641 882 A1 | 3/1995 |
| FR | 1 325 394 A | 7/1963 |
| FR | 2 555 620 A1 | 5/1985 |
| FR | 2 777 917 A1 | 10/1999 |
| WO | WO 93/23602 | 11/1993 |

* cited by examiner

*Primary Examiner*—Victor Sakran
(74) *Attorney, Agent, or Firm*—Oliff & Berridge, PLC

(57) ABSTRACT

A peg has a one-piece clip essentially consisting of two branches, each branch having an anterior part forming a jaw and a posterior part forming a lever arm. The peg also has a hinge around a rotational axis that connects the branches at an intermediate point. A spring extending along a direction substantially perpendicular to the rotational axis is mounted and compressed between the two lever-forming parts of the two branches. The spring urges, under its biasing resilience, the two branches to a closed position. The spring has a biasing force in the direction of increasing its axial longitudinal dimension that is more controllable over time than a spring having a biasing torque. Thus, over time the pressure exerted by the arms of the peg in the closed position remains more constant.

8 Claims, 1 Drawing Sheet

CLOTHES PEG

Clothes Peg

The present invention relates to a clothes peg.

Clothes pegs are conventionally made of two branches made of wood or of synthetic material, which are identical and mounted in opposite directions, which can pivot one with respect to the other. Each branch comprises a posterior part forming a lever arm, and an anterior part forming a jaw, situated facing the corresponding jaw of the other branch and collaborating with this other jaw. A spring connects the two branches and urges them in the direction of tightening the jaws against each other, thus allowing them to grip a piece of washing that is to be hung up to dry.

Clothes pegs made of synthetic material and molded as a single piece so as to form the two branches and a thin connecting region forming a hinge are also known—see, for example, patent applications EP 0 302 135, BP 0 641 882 and WO 93/23602.

In all cases, the branches of these clothes pegs are rigid parts or portions, and this has disadvantages, particularly in terms of the jaws. When these jaws have a relatively smooth surface, the washing is not held firmly enough, and there is a risk that it will slip out of the peg, under the effect of its own weight or under the effect of other influences such as the wind. To avoid this drawback, clothes pegs are often provided with jaws having a toothed profile, which hold the washing more firmly; however, this configuration has the disadvantage that it "marks" the washing to some extent, at; the points where the pegs are located.

Also known, from documents FR 2 556 620 A and DE 528 520 C, are clothes pegs with two branches which are made of a relatively hard material, of which the jaw-forming parts are internally lined with pads or with a coating of a relatively resilient material designed to form the surface for contact with the rod [sic]. In the case of document FR 2 556 620 A, the two branches of the clothes peg each have a symmetric structure, and resilient pads are provided at the two opposed ends of each branch. Thus, the action of the two pads of one end of the peg is countered by the action of the two pads at the other end, which means that the gripping efficiency of such a clothes peg is still rather dubious. As to document DE 528 259 C, that document discloses a clothes peg operated by a cam lever, therefore with a relatively complex mechanism, because it entails an additional axis of pivoting for this lever. The use of such a clothes peg is somewhat impractical, because it requires action simultaneously on the two branches and on the lever, while at the same time holding up the washing that is to be hung out. Finally, the clothes peg of document IE 528 259 C has no spring for returning it to the closed position.

It is an object of the present invention to overcome these drawbacks by providing an improved clothes peg which appreciably improves the holding of the washing while at the same time avoiding "marking" it, the clothes peg proposed remaining of a simple structure and economical to manufacture.

To this end, the subject of the invention is a clothes peg, essentially consisting of two branches each comprising an anterior part forming a jaw, lying facing the corresponding jaw of the other branch, and a posterior part forming a lever arm, the two branches being connected together at an intermediate point along their length by a thin web of material acting as a hinge, and a helical spring for returning them to the closed position being mounted between the two branches, by being positioned via its ends between two bosses, formed one on the interior side of each of the posterior parts of the two branches, while the jaw-forming parts of the two branches, made of a relatively hard material, are internally lined with a coating made of a relatively resilient material, designed to form the surface for contact with the washing, this surface resulting from interior faces of said coating having a corrugated profile or from relatively smooth interior faces of said coating.

Thus, the clothes peg that is the subject of the invention has, as an essential feature, the fact that it is made of two separate materials, a more resilient material being provided on the interior side of the jaws. This resilient material forms "pads" which, when the peg is in use, are squashed elastically and thus hold the washing excellently, especially if the surface finish of the resilient material used, such as silicone or foam, opposes slippage.

This resilient material may in particular adopt the form of two small distinct pads fixed one on the interior side of each of the jaw-forming parts of the two branches of the clothes peg.

In an alternative form, the resilient material adopts the form of a single piece, having a "U"-shaped profile, of which the two opposed wings are fixed one to the interior side of each of the jaw-forming parts of the two branches of the clothes peg. The resilience of the material of which such a U-shaped part is made, naturally allows it to deform in order to "follow" the relative movement of the two branches, when the clothes peg is opened or closed.

Various manufacturing techniques are possible for fixing the parts made of resilient material to the two branches made of a harder material.

In particular, in the case of a clothes peg the two branches of which are made of a molded synthetic material, the parts made of resilient material may be obtained by an industrial, technique of two-shot injection molding or of overmolding, allowing them to be formed and fixed to the corresponding branches simultaneously.

The parts made of resilient material may also be fixed by bonding or by nesting to the two branches made of a harder material.

The effectiveness of the parts made of resilient material may be increased by widening these parts, and the jaw-forming parts of the two branches, by comparison with the remainder of the branches of the clothes peg, this making it possible simultaneously:

- to increase the area for contact with the washing, for a better grip, and
- to distribute the gripping pressure over a larger area, to further limit the risk of "marking" the washing The invention will in any case be better understood with the aid of the description which follows, with reference to the appended schematic drawing which, by way of examples, depicts ai few embodiments of this clothes peg:

Figure 1:
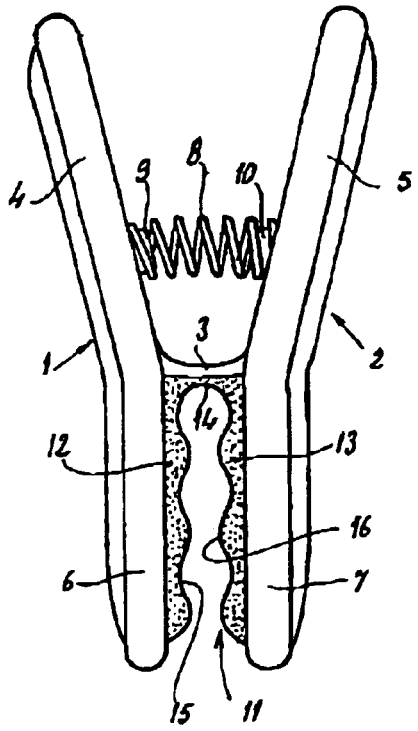
FIG. 1 is a front view of a first embodiment of the clothes peg that is the subject of the present invention.

FIG. 1 shown a clothes peg which comprises two elongate branches 1 and 2 connected to one another at an intermediate point along their length by a thin web of material 3. The two branches 1 and 2 and the web 3 as a whole is made as a single piece, by molding, of a relatively hard synthetic material, the web 3 still, by virtue of its small thickness, maintaining a certain flexibility which allows it to act as a hinge. Each branch 1 or 2 comprises a posterior part, 4 or 5 respectively, forming a lever arm, and an anterior part, 6 or 7 respectively, forming a jaw. A helical spring 8 for returning to the closed position is mounted between the two branches 1 and 2, the spring a being positioned, by its ends, on two bosses 9 and 10 formed one on the interior side of each of the posterior parts 4 and 5 situated facing each other of the two branches 1 and 2.

The respective anterior parts 6 and 7 of the two branches 1 and 2, forming jaws, are also situated facing each other, and are internally coated with a resilient material. More particularly, in the exemplary embodiment illustrated in FIG. 1, a single piece 11 of U-shaped profile, made of a resilient material such as silicone or foam is provided and forms two opposed wings 12 and 13 joined together by an intermediate region 14. The two wings 12 and 13 are applied and fixed respectively against the interior faces of the respective anterior parts 6 and 7 of the two branches 1 and 2, while the intermediate region 14 is pressed against the thin web 3. The respective interior faces 15 and 16 of the two wings 12 and 13, which face towards each other, have a corrugated profile and, when the clothes peg is in use, constitute the surfaces for contact with the washing. By virtue of the resilience of the material of which the part 11 is made and by virtue of the squashing of this material at the wings 12 and 13, the washing is held more firmly and the undesirable "marking" of this washing is avoided. In addition, the resilience of the part 11, particularly in its intermediate region 14, allows it to "follow" the deformation of the thin web 3 and the relative movement of the two branches 1 and 2 when the clothes peg is opened or closed.

Figure 2:
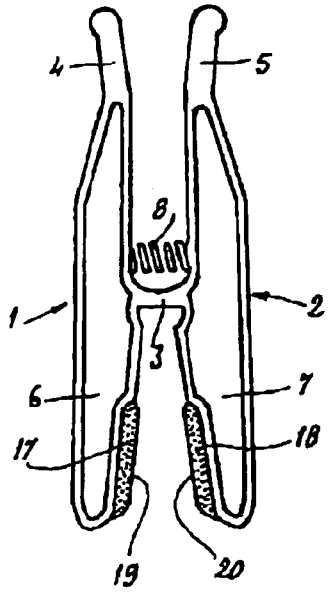
FIG. 2 is a front view of a second embodiment of this clothes peg.

FIG. 2 depicts a clothes peg of the same general design as the one in FIG. 1, in terms of its two branches 1 and 2 and the web of material 3 connecting these two branches 1 and 2, this assembly also being made as a single piece of a relatively rigid synthetic material. The respective anterior parts 6 and 7 of the two branches 1 and 2, forming jaws, here respectively, on their interior faces, take two small pads 17 and 18 of resilient material, thus placed facing each other. The pads 17 and 19 are positioned in abutment against shoulders of the jaw-forming parts 6 and 7. The respective interior faces 19 and 20 of these two pads 17 and 18, which faces face toward each other, here are relatively smooth and, when the clothes peg is in use, constitute the surfaces for contact with the washing. As before, by virtue of the resilience of the material of which the two pads 17 and 18 are made, and by virtue of the squashing thereof, the washing is held very firmly with no "marking" effect.

Figure 3:
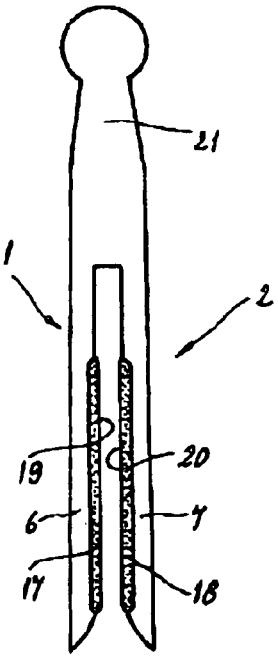
FIG. 3 is a front view of a third embodiment of this clothes peg.

FIG. 3 illustrates the application of the invention to another type of clothes peg comprising two roughly parallel branches 1 and 2 secured in the posterior part 21 of the clothes peg, this type of clothes peg being marketed in particular in the countries in northern Europe. The respective anterior parts 6 and 7 of the two branches 1 and 2, again here forming jaws, are, as in the previous embodiments, lined with a coating of resilient material, by comparison with the remainder of the peg which is made of a relatively hard material, but still however having a certain elasticity in the region of the two branches 1 and 2. The resilient part here again adopts the form of two pads 17 and 18 fixed to the interior faces of the respective anterior parts 6 and 7 of the two branches 1 and 2.

The two pads 17 and is made of resilient material can, during the manufacture of the clothes pegs, be fixed to the respective anterior parts 6 and 7 of the two branches 1 and 2 in various ways: two-shot injection molding, overmolding, bonding, nesting, snap-fastening.

As goes without saying, the invention is not restricted merely to the exemplary embodiments of this clothes peg which have been described hereinabove by way of example; an the contrary, it encompasses all alternative forms of embodiment and of application thereof which follow the same principle. Thus, in particular, it would not be departing from the scope of the invention if:

the resilient parts were produced with other shapes and/or from other suitable materials;

these flexible parts were fixed to the two branches of the clothes peg by any means;

the invention were applied to clothes pegs of any type and any shape, the branches of which could be produced from any relatively hard material.

What is claimed is:

1. A peg comprising:

a one-piece clip molded from a relatively hard synthetic material, said clip consisting essentially of two branches, each branch comprising an anterior part forming a jaw and a posterior part forming a lever arm, and a thin web of said synthetic material acting as a hinge around a rotational axis and connecting together said branches at an intermediate point thereof, two pads made of a relatively resilient synthetic material, respectively fixed on the jaw-forming parts of the two branches, each having an interior face arranged for contact with an article, a spring extending along a direction substantially perpendicular to said rotational axis, mounted and compressed between the two lever-forming parts of the two branches, and thus urging, under a biasing resilience of the spring, said two branches toward each other into a closed position, wherein a one-piece lining made of said resilient material, having a U-shaped profile, covers an interior side of the clip determined by the two anterior parts and the web of said clip, thus forming said two pads.

2. A peg according to claim 1, wherein two bosses are formed on the interior side of respectively the two posterior parts of the two branches, and the two ends of spring fit respectively in said two bosses, wherein the spring is helical.

3. A peg according to claim 1, wherein said pads are distinct from one another.

4. A peg according to claim 1, wherein the two pads and jaw-forming parts of the two branches are wider in comparison with the remainder of said branches.

5. A peg comprising:

a one-piece clip molded from a relatively hard synthetic material, said clip consisting essentially of two branches, each branch comprising an anterior part forming a jaw and a posterior part forming a lever arm, and a thin web of said synthetic material acting as a hinge around a rotational axis and connecting together said branches at an intermediate point thereof, two pads made of a relatively resilient synthetic material, respectively fixed on the jaw-forming parts of the two branches, each having an interior face arranged for contact with an article, a spring extending along a direction substantially perpendicular to said rotational axis, mounted and compressed between the two lever-forming parts of the two branches, and thus urging under a biasing resilience of the spring said two branches toward each other into a closed position, wherein the clip is molded in a neutral position in which the two branches remain open, with the two interior faces of the two pads out of contact from each other.

6. A peg according to claim 5, wherein two bosses are formed on the interior side of respectively the two posterior parts of the two branches, and the two ends of spring fit respectively in said two bosses, wherein the spring is helical.

7. A peg according to claim 5, wherein said pads are distinct from one another.

8. A peg according to claim 5, wherein the two pads and jaw-forming parts of the two branches are wider in comparison with the remainder of said branches.

* * * * *